US006227215B1

(12) United States Patent
Akazawa

(10) Patent No.: US 6,227,215 B1
(45) Date of Patent: May 8, 2001

(54) PIPING CLEANING DEVICE

(76) Inventor: Yasumasa Akazawa, 2-18-14, Higashinmachi, Matsubara, Osaka (JP)

( * ) Notice: Subject to any disclaimer, the term of this patent is extended or adjusted under 35 U.S.C. 154(b) by 0 days.

(21) Appl. No.: 09/256,442

(22) Filed: Feb. 23, 1999

(51) Int. Cl.[7] ..... B08B 9/04

(52) U.S. Cl. ..... 134/169 C; 134/103.1; 134/166

(58) Field of Search ..... 134/166 R, 167 R, 134/168 C, 167 C, 169 C, 166 C, 169 R, 103.1

(56) References Cited

U.S. PATENT DOCUMENTS

| | | | | |
|---|---|---|---|---|
| 2,690,756 | * | 10/1954 | Palley et al. | 134/166 C |
| 2,771,891 | * | 11/1956 | Palley | 134/169 C |
| 2,845,935 | * | 8/1958 | Palley | 134/166 C |
| 3,094,998 | * | 6/1963 | Gley | 134/166 C |
| 3,118,456 | * | 1/1964 | Palley | 134/166 C |
| 3,670,744 | * | 6/1972 | Bender | 134/169 C |
| 3,851,342 | * | 12/1974 | Moore | 134/169 C |
| 4,874,002 | * | 10/1989 | Sundholm | 134/169 C |
| 4,919,154 | * | 4/1990 | Engle | 134/169 C |
| 4,941,593 | * | 7/1990 | Hicks et al. | 134/169 C |
| 5,007,444 | * | 4/1991 | Sundholm | 134/169 C |
| 5,107,875 | * | 4/1992 | Sundholm | 134/169 C |
| 5,159,956 | * | 11/1992 | Kurihara | 134/169 C |
| 5,265,629 | * | 11/1993 | Sajewski | 134/169 C |
| 5,289,838 | * | 3/1994 | Odell | 134/166 C |
| 5,551,462 | * | 9/1996 | Biermaier | 134/169 C |
| 5,615,695 | * | 4/1997 | Chambers | 134/169 C |
| 5,858,114 | * | 1/1999 | Bosrd et al. | 134/169 C |

* cited by examiner

*Primary Examiner*—Frankie L. Stinson
(74) *Attorney, Agent, or Firm*—Moonray Kojima

(57) ABSTRACT

The present invention relates to a piping cleaning device for cleaning the inside of the piping installed in building, residence, fountain, structure, etc., in a piping system for transferring liquids such as clean water, cooling water, solution, chemical solution, water liquid, liquid raw material, etc., which can, by connecting a liquid storing tank, in which is stored a prescribed volume of cleaning solution, to one end side of the piping, connecting to the other end side a sealed tank for storing the cleaning solution discharged from that side and providing a liquid feed means for feeding a flow of cleaning solution between the two tanks through the inside of the piping, clean the piping by alternately repeating the action of feeding and flowing the cleaning solution to the liquid storing tank and the sealed tank through the inside of the piping to make the cleaning solution pass to the entire areas of the piping up to the small pipes at the terminals, accurately clean and eliminate obstinate dirt adhering to the inside of the piping by applying the pressure and impact of the cleaning solution from different directions against the dirt adhering to the inside of the piping, promote improvement of working efficiency by making it possible to perform the cleaning work in a short time and efficiently and yet reduce the amount of cleaning solution to be supplied and thus reduce the amount of loss by feeding and recovering the cleaning solution from one end side of the piping, and is economical and capable of not only reducing the cleaning cost but also facilitating the installation work.

6 Claims, 10 Drawing Sheets

PIPING CLEANING DEVICE

BACKGROUND OF THE INVENTION

1. Field of the Invention

The present invention relates to a piping cleaning device for cleaning the inside of the piping installed in building, residence, fountain, structure, etc., in a piping system intended for transferring liquids such as clean water, cooling water, solution, chemical solution, water liquid, liquid raw material, etc.

2. Description of the Prior Art

Conventionally, there exists, as device for cleaning piping, a device which cleans and removes dirt adhering to the inside of a piping by once storing at high pressure in an accumulator a cleaning solution stored in a tank, and then opening the valve to flow the cleaning solution stored in the accumulator at a stroke through the inside of the piping.

However, this device, which performs cleaning by flowing a cleaning solution from one end side to the other end side of the piping, requires continuous circulatory supply of a large amount of cleaning solution, and it is rather difficult to maintain a proper flow velocity and a pressure suitable for eliminating the dirt.

Moreover, another problem with this device is that, since the direction of flow of the cleaning solution is specified in one direction, the pressure and impact of the cleaning solution are applied from one direction only and not from the other direction and, for that reason, it is rather difficult to clean and remove obstinate dirt, making it necessary to repeat the operation of circulatory supply of cleaning solution many times in the case of presence of heavy dirt inside the piping, and taking a lot of labour and time for the cleaning of the entire piping.

Furthermore, in the case where a plural number of small pipes are installed on the piping, the transfer pressure of the cleaning solution flowing through the inside of the piping drops and the flow velocity and pressure of the cleaning solution change when the faucet provided at the discharge port of a small pipe is opened, and this makes it necessary to supply a still larger amount of cleaning solution at higher pressure, thus taking much time for the storage and pressurization of that cleaning solution and deteriorating the working efficiency.

On the other hand, still another problem is that, if either the discharge port or faucet of the small pipes is blocked, the fluid resistance inside the small pipes increases and the cleaning solution cannot be supplied to the terminal portion of the small pipes, thus making it impossible to remove dirt adhering to the inside of the small pipes.

SUMMARY OF THE INVENTION

The main objective of the present invention is to provide a piping cleaning device which can, by connecting a liquid storing tank, in which is stored a prescribed volume of cleaning solution, to one end side of the piping, connecting, to the other end side, a sealed tank for storing the cleaning solution discharged from that side and providing a liquid feed means for feeding a flow of cleaning solution between the two tanks through the inside of the piping, clean the piping by alternately repeating the action of feeding and flowing the cleaning solution to the liquid storing tank and the sealed tank through the inside of the piping to make the cleaning solution reach the entire areas of the piping up to the small pipes at the terminals, accurately clean and remove obstinate dirt adhering to the inside of the piping by applying the pressure and impact of the cleaning solution from different directions against the dirt adhering to the inside of the piping, promote improvement of working efficiency by making it possible to perform the cleaning work in a short time and efficiently and yet reduce the amount of cleaning solution to be supplied and thus reduce the amount of loss by feeding and recovering the cleaning solution from one end side of the piping, and is economical and capable of not only reducing the cleaning cost but also facilitating the installation work.

Another objective of the present invention is to provide a piping cleaning device which can, by connecting a sealed tank to the discharge port of the small pipes, temporarily store the cleaning solution discharged from the discharge port, accurately prevent the cleaning solution from splashing to the surrounding areas, and also accurately clean and eliminate dirt adhering to the inside of the piping.

Still another objective of the present invention is to provide a piping cleaning device which can, by constructing the liquid feed means with a pulsating feed means which pressurizes the cleaning solution when supplying it to the sealed tank and releasing the pressurization when recovering the solution to the liquid storing tank, repeat the action of pressure feeding the cleaning solution and the action of recovering the solution with release of pressurization, to make the cleaning solution pulsate and accurately clean and eliminate the dirt adhering to the inside of the piping with changes in flow velocity and pressure.

Yet another objective of the present invention is to provide a piping cleaning device which can, by constructing the liquid feed means with an reciprocating feed means, repeatedly apply pressure and impact to the cleaning solution from both the direction of feed and the direction of recovery to eliminate the dirt adhering to the inside of the piping.

A further objective of the present invention is to provide a piping cleaning device which can, by providing on the liquid feed means a switching means for switching the cleaning solution between a feed route and a recovery route, perform continuous operation without requiring stop and reverse turn of the liquid feed means, enable quick motion of feeding and recovering the cleaning solution, and thus improve the efficiency of cleaning work.

A still further objective of the present invention is to provide a piping cleaning device which can, by providing a means for applying ultrasonic vibrations to at least one of the cleaning solution and the piping, apply ultrasonic vibrations produced by the ultrasonic wave furnishing means to at least one of the cleaning solution and the piping, accurately separate obstinate dirt adhering to the inside of the piping with the synergism of pulsation or alternation of cleaning solution and ultrasonic vibrations, so as to accurately clean and eliminate even dirt sticking to corners and detailed parts inside the pipes and beautifully clean the inside of the piping, without being influenced by the size of pipe diameter and the situation of piping.

A yet further objective of the present invention is to provide a piping cleaning device which can, by providing a finishing liquid feed means for supplying finishing liquid, for washing away the residuals remaining inside the piping, to one end side of the piping, wash away the residuals remaining inside the piping with the finishing liquid, and finish and clean the inside of the piping into a clean and hygienic state.

Still another objective of the present invention is to provide a piping cleaning device which can, by sealing, in a sealed tank, a gas for discharging the cleaning solution stored in that tank, discharge the cleaning solution with the pressure of this gas, thus making it unnecessary, when discharging the liquid, to reverse the liquid feed means and suck the cleaning solution, shortening the time for recovery and reversing of flow, and enabling efficient execution of the cleaning work.

Yet another objective of the present invention is to provide a piping cleaning device which makes it possible, by constructing at least part of the tank in a way to enable visual check from outside of the cleaning solution in the tank, to visually control the degree of staining of the cleaning solution stored in the tank, easily grasp the state of cleaning inside the piping and, since the cleaning effect drops as the amount of foreign matters contained in the cleaning solution increases, accurately grasp the time for replacement of the cleaning solution by visually checking the degree of staining of the cleaning solution either at prescribed intervals or periodically, thus enabling to perform the cleaning work continuously by replacing the cleaning solution with a new one.

A further objective of the present invention will become clear easily from the description of the embodiment to be explained hereafter.

DESCRIPTION OF THE PREFERRED EMBODIMENT

An embodiment of the present invention will be described in detail hereafter by referring to drawings.

Figure 1:
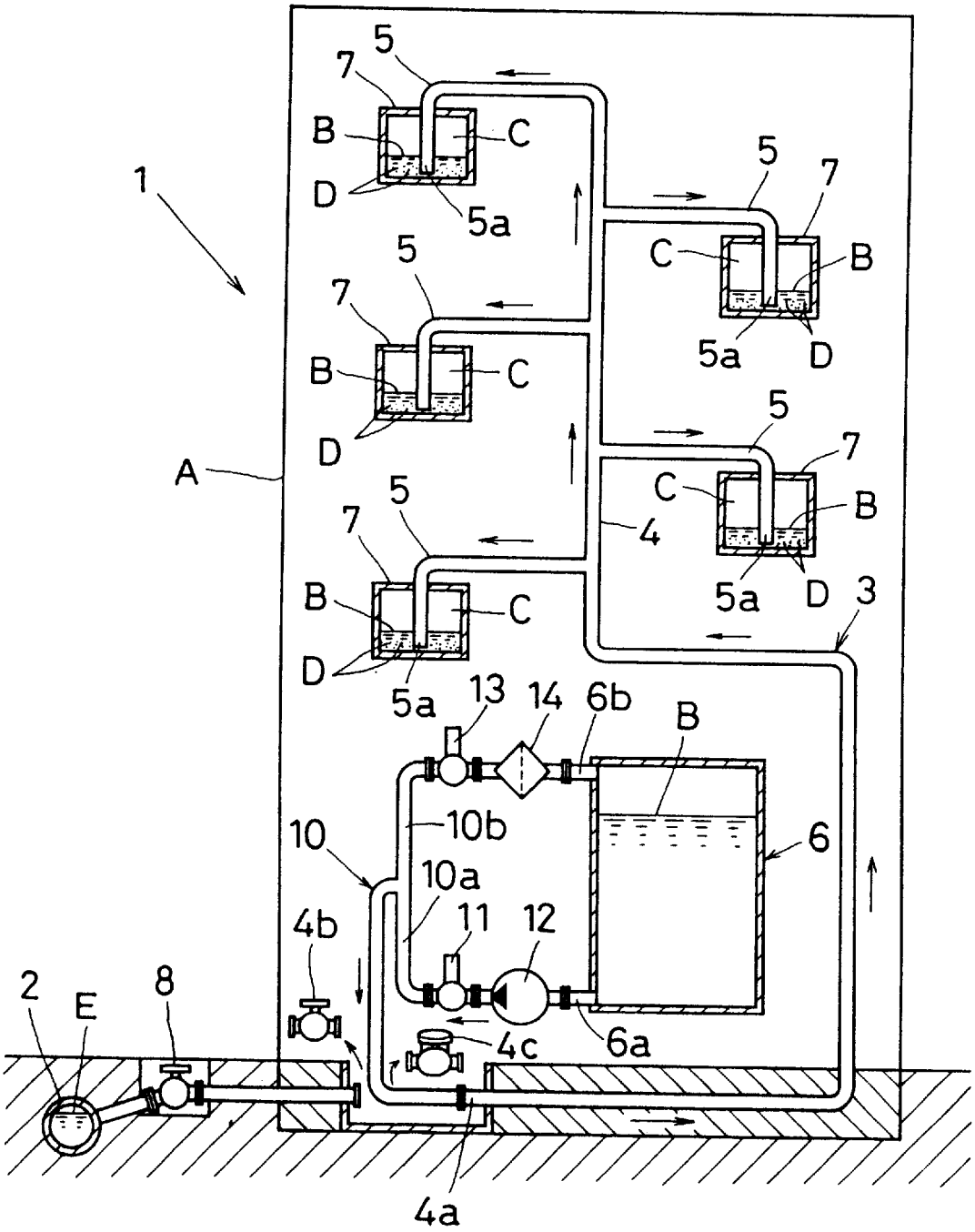
FIG. 1 is a side view showing the piping cleaning device according to the present invention.

The drawings show a piping cleaning device for cleaning a piping system for water supply or draining disposed inside a building. In FIG. 1, this piping cleaning device 1, provided between the main pipe 2 disposed outside a building A and the piping 3 disposed inside the building A, is a device which connects main tank 6 to the main pipe 4 constituting the piping 3, connects sealed type auxiliary tank 7 to a plural number of small pipes 5 provided on the main pipe 4, and then drives (including both continuous driving and intermittent driving), stops or reverses pump 12, so as to feed cleaning solution B stored in the main tank 6 to the auxiliary tank 7 through the small pipe 5, and clean and remove dirt D adhering to the inside of the piping 3 by means of the cleaning solution B.

The piping 3, connected to the main pipe 2 disposed outside the building A (buried under the road, etc.) through main valve 8 (stop valve), supplies a liquid E such as clean water, etc. flowing through the main pipe 2 to the main pipe 4 and the small pipe 5, with either the transfer pressure of the liquid E itself or the transfer force of a lift pump (outside the illustration).

To the main pipe 4 are connected a plural number of small pipes 5 disposed inside the building A (kitchen, bathroom, toilet, etc.), and faucet (not illustrated) is attached to the discharge port 5*a* of the small pipes 5.

The main tank 6 is connected, after removing the valve 4*b* and the water measuring instrument 4*c* (meter) from the discharge port 4*a* of the main pipe 4, to the discharge port 4*a* in a state isolated from the atmosphere (sealed state or liquid-tight state), through feed pipe 10.

Here, the feed pipe 10 may be connected to the discharge port 4*a*, through the valve 4*b* and the water measuring instrument 4*c* or through the water measuring instrument 4*c* only.

In the main tank 6 is stored cleaning solution (natural oxygen detergent, etc.) in prescribed volume i.e. a volume sufficient for filling the total capacity inside the main pipe 4 and the small pipes 5 and supplying in about an equal volume to the auxiliary tank 7.

The feed pipe 10 is branched into a plural number, and one branch pipe 10*a* is connected to discharge port 6*a* at the bottom of the main tank 6, through solenoid valve 11 and pump 12 (centrifugal pump, rotary pump, etc.).

The other branch pipe 10*b* is connected to recovery port 6*b* at the top of the main tank 6, through solenoid valve 13 and filter 14.

Figure 2:
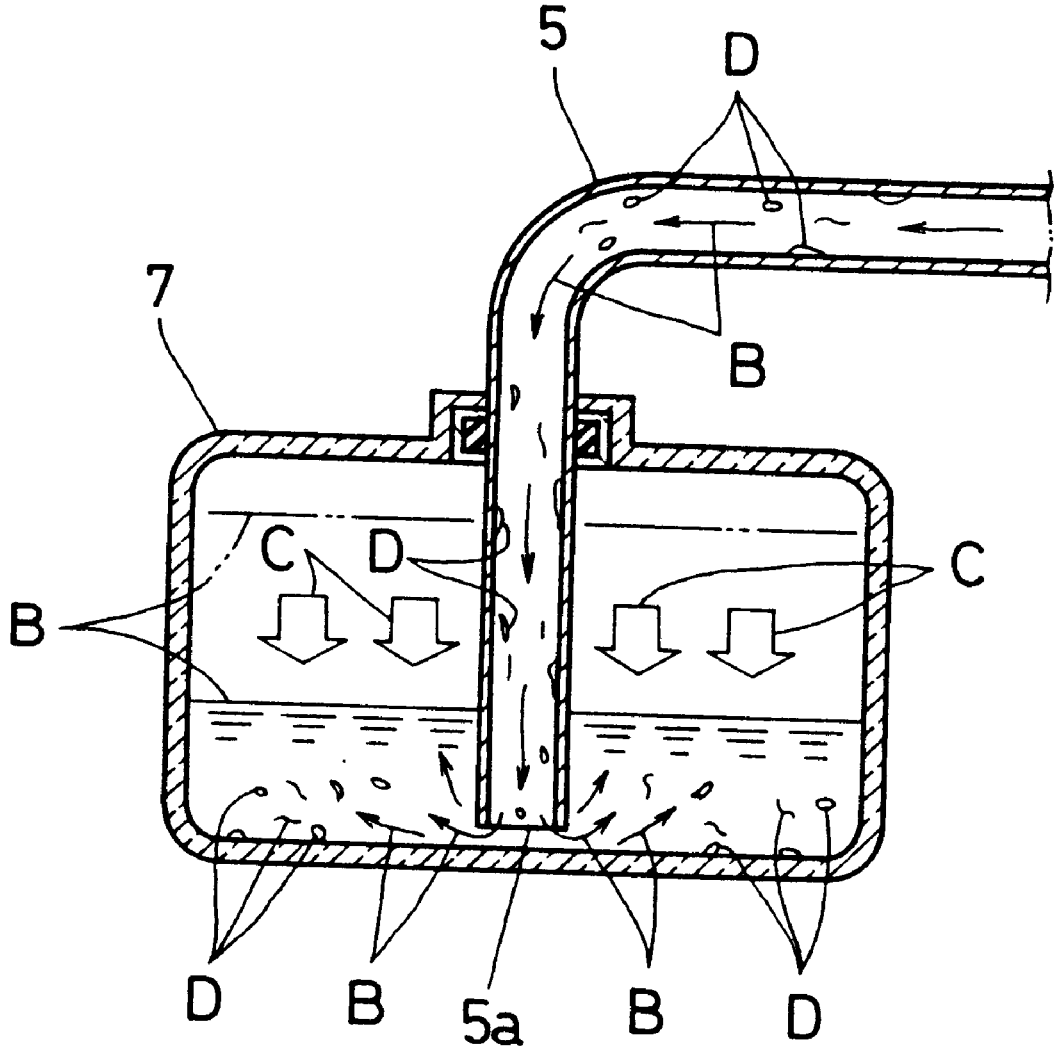
FIG. 2 is a cross-sectional view showing the state of cleaning inside the pipe.
Figure 3:
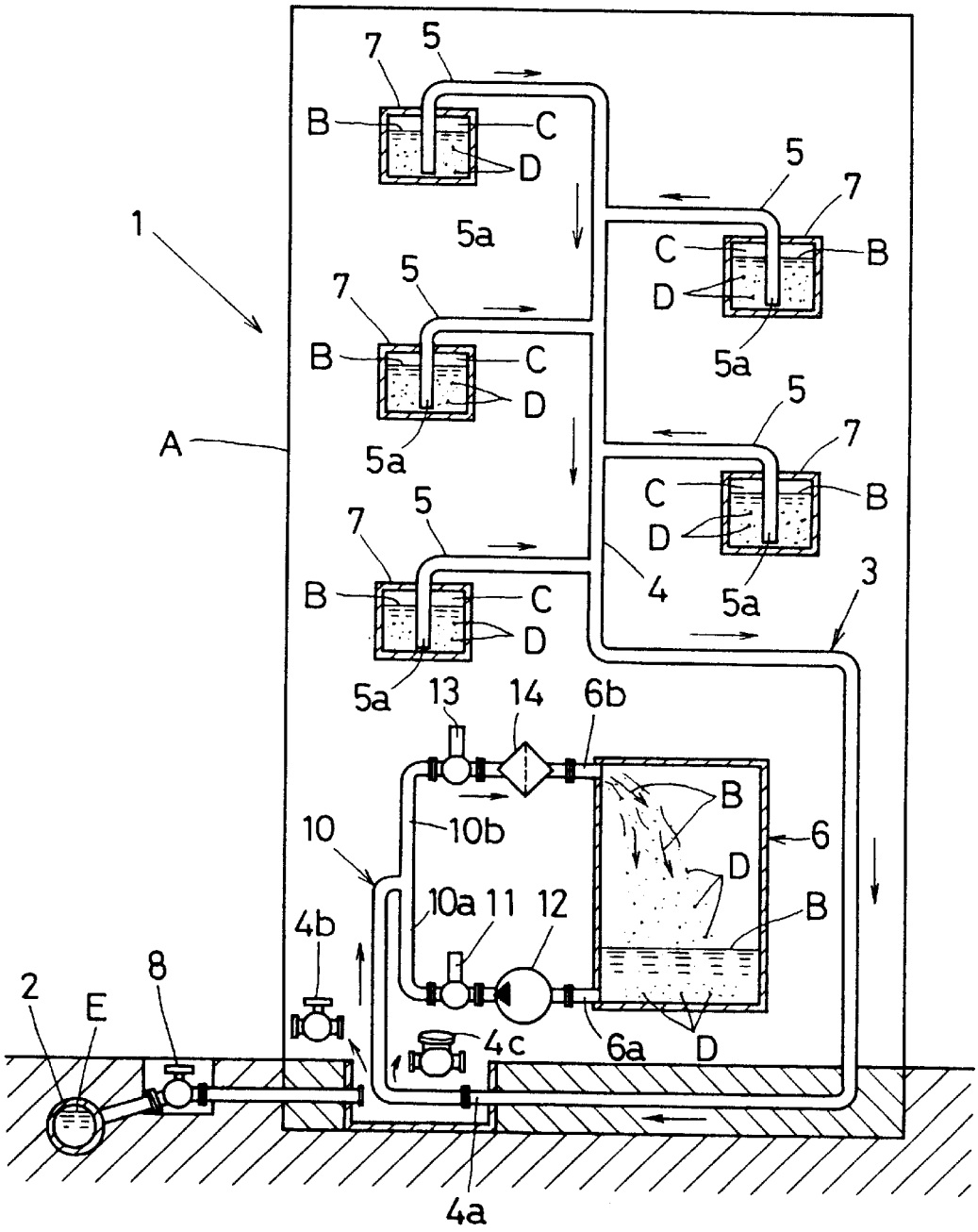
FIG. 3 is a side view showing the cleaning solution recovering action.
Figure 4:
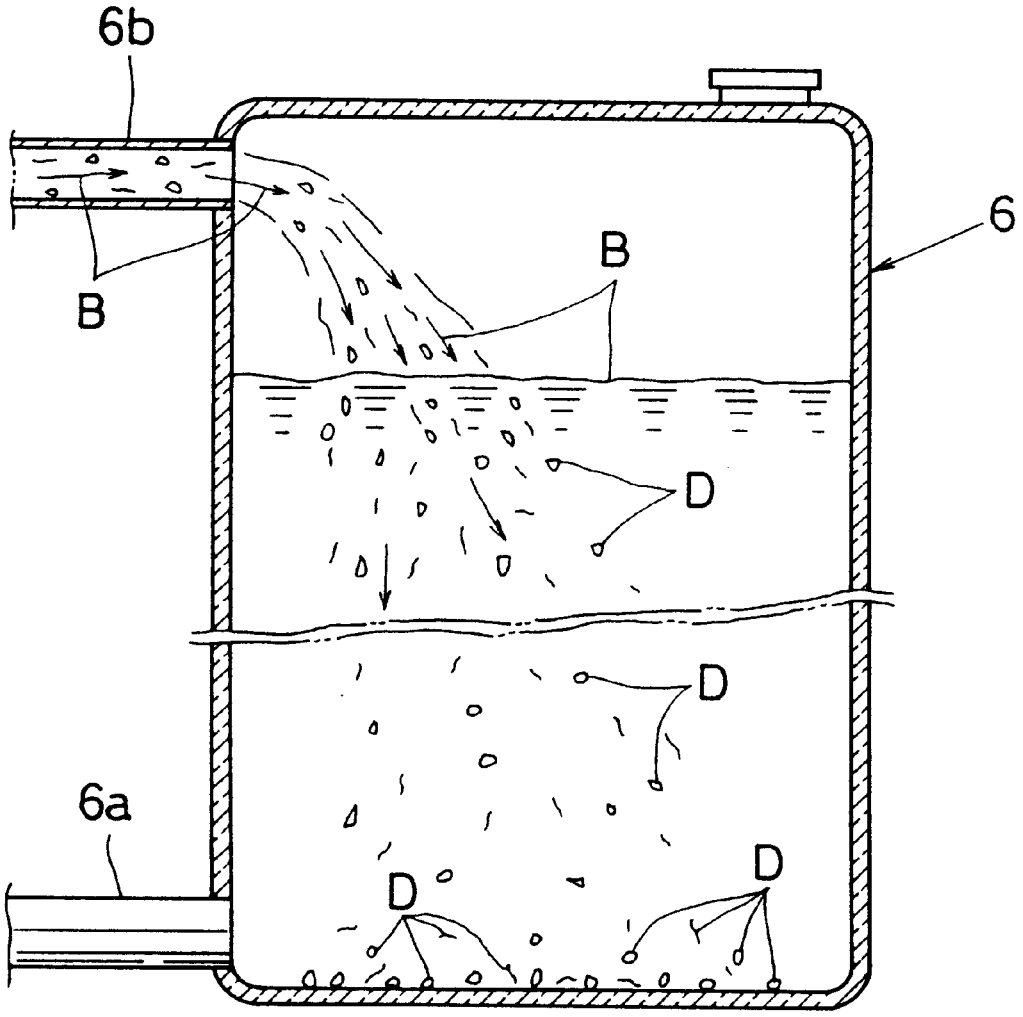
FIG. 4 is a cross-sectional view showing the state of recovery and visually checked state of the cleaning solution.

The auxiliary tank 7 is connected, after removing the faucet from the discharge port 5*a* of the small pipe 5, to the discharge port 5*a* in a state isolated from the atmosphere (sealed state or liquid-tight state), as shown in FIG. 2.

The auxiliary tank 7 is set for a volume which is filled about completely with the cleaning solution B discharged from the discharge port 5*a*. In the lower area inside the auxiliary tank 7 is stored cleaning solution B of heavy specific gravity, while in the upper area is stored gas C (air, gas, etc. not easily soluble in the liquid E nor causing chemical reaction, gas harmless to human body, etc.) of a specific gravity smaller than that of the cleaning solution B.

The small pipe 5, provided in a state close to but separate from the bottom of the auxiliary tank 7, sucks and discharges about the total volume of the cleaning solution B stored in the auxiliary tank 7.

Part or whole of the main tank 6 and the auxiliary tank 7 are formed transparent or translucent with material such as synthetic resin, glass, etc. and constructed in a way to enable visually checking the cleaning solution B stored in the tanks 6, 7 from outside.

Moreover, it may also be all right to fix a transparent or translucent sheet or membrane, to the window (not illustrated) formed on the side part of the tanks 6, 7.

Here, the liquid used as cleaning solution B may be a liquid suitable for either separating or decomposing the dirt D, depending on the composition of the dirt D adhering to the inside of the piping or degree of staining such as a liquid mainly composed of natural component, chemical component or complex liquid, liquid harmless to human body, cleaning liquid B mixed with granular substance, for example.

The illustrated embodiment is constructed as described above, and its actions will be described hereafter.

First, as shown in FIG. 1, after closing the main valve 8, remove the valve 4*b* and the water measuring instrument 4*c* from the main pipe 4, and discharge the liquid E remaining in the pipe, through the feed port 4*a* of the main pipe 4.

This discharge may be made also through the discharge port 5*a* of the small pipe 5 or through a faucet provided at the discharge port 5*a*.

After that, connect the main tank 6 to the feed port 4*a*, through the feed pipe 10, in a state isolated from the atmosphere side.

Figure 6:
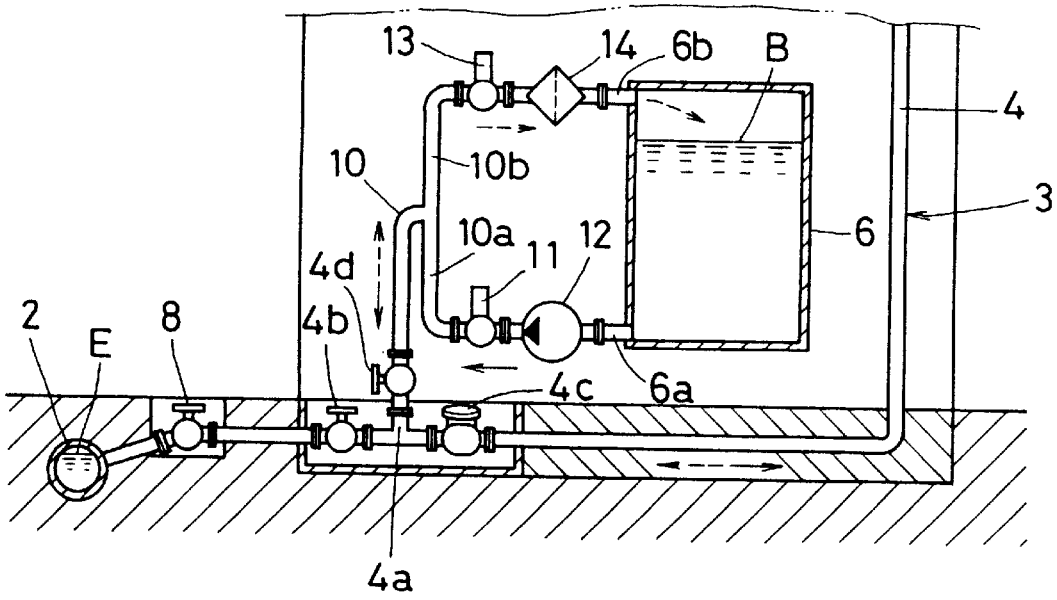
FIG. 6 is a side view indicating other connecting construction of the main tank.

It is also all right, as shown in FIG. 6, to connect the feed pipe 10, through the valve 4*d*, to the feed port 4*a* provided on the rear side of either the valve 4*b* or the main valve 8. In this case, the workability improves because the step of removing the valve 4*b* can be omitted.

On the other hand, as shown in FIG. 2, remove the faucet from the discharge port 5*a* of the small pipe 5, and connect empty auxiliary tank 7 to the discharge port 5*a* in a state isolated from the atmosphere side.

The auxiliary tank 7 may be directly connected to the faucet attached to the discharge port 5*a*, or it may also be all right to discharge the residual liquid E by feeding the cleaning solution B from the main pipe 4 to the small pipe 5, before connecting the auxiliary tank 7.

Another possibility is to open the solenoid valve 11 to drive the pump 12 and feed the cleaning solution B in the main tank at a time from the main pipe 4 to the small pipe 5, and instantaneously apply a high pressure (approx. 17.5 kgf/cm2) at the same time to give impacts to the dirt D adhering to the inside of the pipe. The pressure and the feed volume may be changed as desired, depending on the pipe diameter or length of the piping 3.

The cleaning solution B is fed sequentially from the small pipe 5 on the side closer to the feed port 4*a* of the main pipe, by being let flow from the main pipe 4 to the small pipe 5, and the cleaning solution B is forcibly fed to the auxiliary tank 7 against the pressure of the gas C, to compress the gas C.

When the entire space in the main pipe 4 and the small pipe 5 is filled with the cleaning solution B and that the cleaning solution B is stored in the auxiliary tank 7, the drive of the pump 12 is stopped, the solenoid valve 11 on one side is closed, and the solenoid valve 13 on the other side is opened, to discharge the cleaning solution B containing dirt D from the auxiliary tank 7 and flow it in the reverse direction at a time from the small pipes 5 toward the main pipe 4, under the pressure (expansive force) of the gas C in the auxiliary tank 7.

When the back-flow solution passes through the filter 14 provided in the branch pipe 10*b*, large foreign matters (dust, metal, etc.) are separated and removed from the cleaning solution B, and the cleaning solution B containing fine dirt D is made to return (about the entire volume or an optional volume) to the main tank 6.

At the time intervals set in advance, the pump 12 is driven and stopped and, in linkage with the drive and stop of the pump 12, the solenoid valves 11, 13 are opened and closed, to pressure feed the cleaning solution B in the main tank 6 to the auxiliary tank 7 through the main pipe 4 and the small pipe 5.

On the other hand, the action of releasing the pressurization by the pump 12 and recovering the cleaning solution B by making it back flow through the main pipe 4 and the small pipe 5, under the pressure of the gas C in the auxiliary tank 7, is alternately repeated, to produce pulsation of the cleaning solution B fed into the main pipe 4 and the small pipe 5, thus making it possible for the cleaning solution B to accurately reach all areas of the piping 3 from the main pipe 4 up to the small pipe 5, to accurately clean and remove obstinate dirt D adhering to the inside of the piping 3.

Since the cleaning solution B is discharged from the discharge port 5*a* of the small pipe 5 and fed to the auxiliary tank 7, it is possible to well clean the entire inside of the small pipe 5 up to small corners.

Visually control from outside the degree of staining of the cleaning solution B stored in either the main tank 6 or the auxiliary tank 7, to judge if the dirt D adhering to the inside of the main pipe 4 and the small pipe 5 has been removed or not.

In the case where the inside of the pipes is badly stained, continue the cleaning work until the inside of the main pipe 4 and the small pipe 5 becomes clean, by either repeating said operations or replacing the cleaning solution B with a new one.

Figure 7:
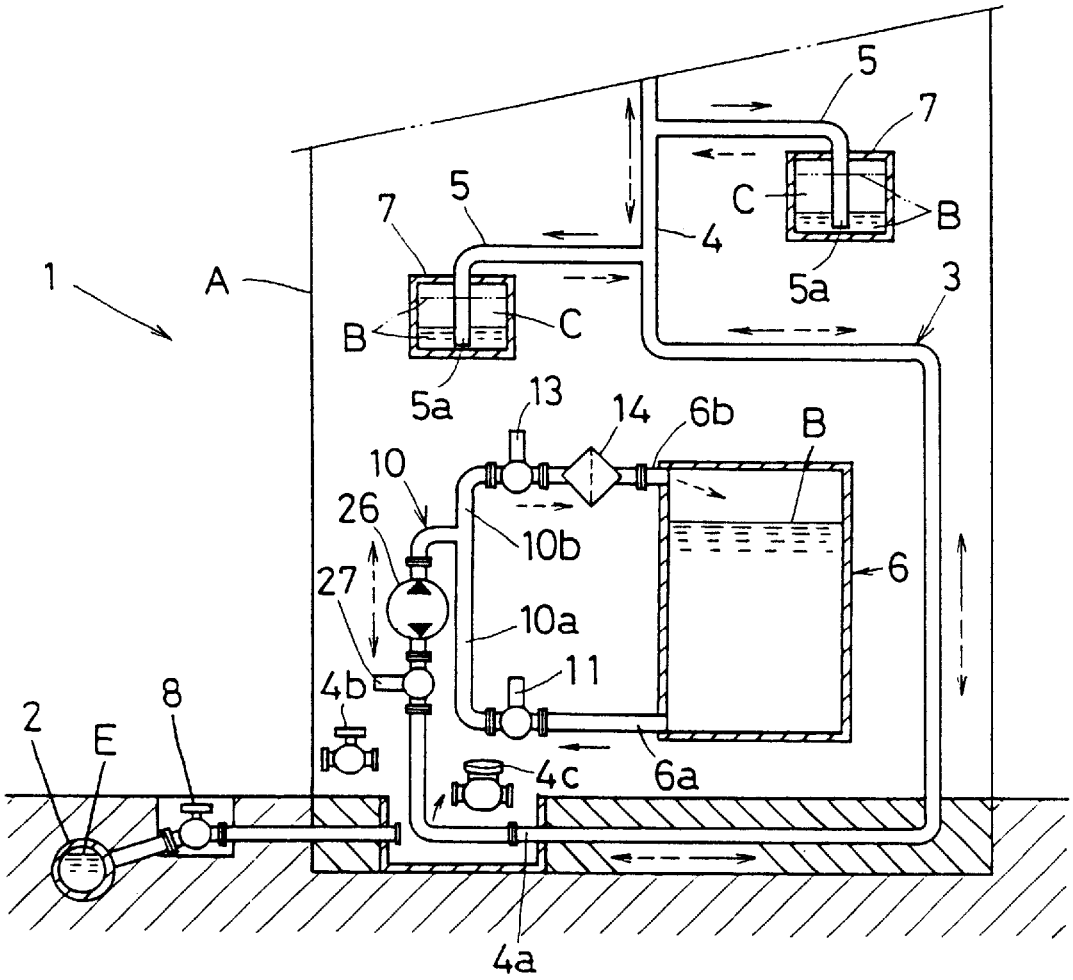
FIG. 7 is a side view indicating the actions of feeding and recovering the cleaning solution with a pump.

Moreover, it is also possible to accurately clean and remove obstinate dirt D adhering to the inside of the main pipe 4 and the small pipe 5, in the same way as above, by connecting the feed pipe 10 to the feed port 4*a* of the main pipe 4 through a pump 26 and a solenoid valve 27, as shown in FIG. 7, and alternately repeating the actions of pressure feeding the cleaning solution B in the main tank 6 to the auxiliary tank 7 through the inside of the piping 3 and recovering the solution to the main tank 6 by making it back flow through the piping 3.

When the cleaning work is completed, the cleaning solution B stored in the main pipe, the small pipe 5 and the auxiliary tank 7 is made to back flow, as shown with dotted arrow mark in FIG. 7, from the small pipe 5 to the main pipe 4, to suck and recover the cleaning solution B to the main tank 6.

Furthermore, it is also possible to recover used cleaning solution B to the main tank 6, either under the pressure of the gas C or by natural gravitational flow of the cleaning solution B.

Figure 5:
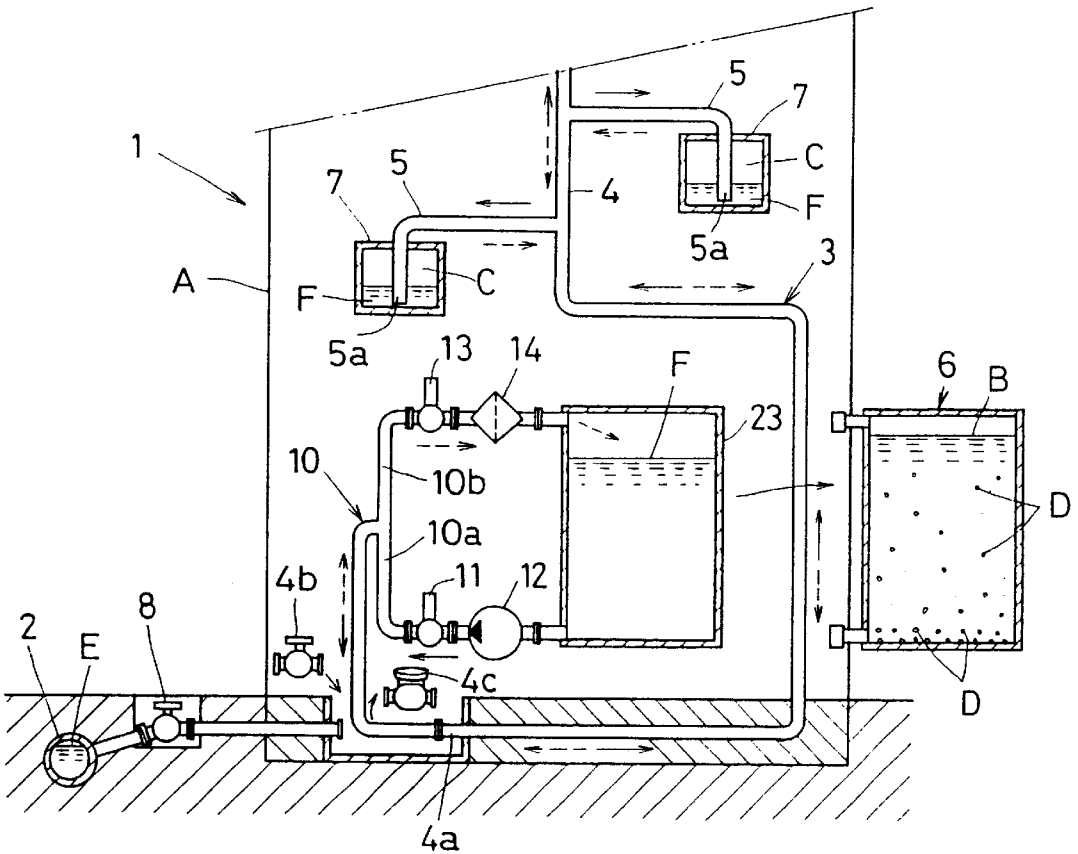
FIG. 5 is a side view indicating the finish cleaning inside the pipe.

Next, when finish cleaning the inside of the piping 3, remove the main tank 6, in which is recovered the cleaning solution B, from the connecting portion, and then connect a finishing tank 23, in which is stored finishing liquid F, to the feed port 4*a* through the feed pipe 10, as shown in FIG. 5.

Drive the pump 12 in FIG. 5 to feed the finishing liquid F (liquid harmless to human body, such as clean water, distilled water, etc.) at a time from the main pipe 4 to the small pipe 5 in the same way as above, to forcibly wash away the residues (cleaning solution, dirt, foreign matters, etc.) remaining in the main pipe 4 and the small pipe 5 at a stroke, and make finish cleaning.

After completion of the finish cleaning, either operate the pump 12 in the reverse direction or make the finishing liquid F flow down with its own weight, to recover the finishing liquid F to the finishing tank 23.

Still more, it is also all right to remove the auxiliary tank 7 from the discharge port 5*a* of the small pipe 5, and make the finishing liquid F flow from the main pipe 4 to the small pipe 5 at a time and discharge it from the discharge port 5*a* of the small pipe 5, for the finish cleaning.

The finish cleaning can also be made by opening, after taking out the auxiliary tank 7 from the discharge port 5*a* and attaching the valve 4*b* and the water measuring instrument 4*c* to the feed port 4*a* of the main pipe 4, the valve 4*b* and the main valve 8 and feeding the liquid E supplied from the main pipe 2 to the main pipe 4 and the small pipe 5.

In this way, since the inside of the piping 3 is cleaned by driving the pump 12 and repeating the action of making the cleaning solution B flow through the inside of the piping 3 to feed it to the main tank 6 and the auxiliary tank 7 alternately and causing pulsation of the cleaning solution B, it becomes possible to make the cleaning solution B reach all areas of the piping 3 from the main pipe 4 up to the small pipe 5 accurately, to clean the entire areas. Moreover, the pressure and impact of the cleaning solution are applied from different directions against the dirt adhering to the inside of the piping 3, making it possible to not only accurately clean and eliminate obstinate dirt adhering to the inside of the piping 3 with changes of flow velocity and pressure but also perform the cleaning work in a short time, thus promoting improvement of working efficiency.

And yet, since the cleaning solution B is supplied and recovered through the feed port 4*a* of the main pipe 4, the amount of cleaning solution B to be supplied can be reduced and the amount of loss also becomes smaller, and this enables economical cleaning with reduced cost. In addition, the installation work of the equipment can be made simply and easily, because there is no need of connecting the both ends of the piping in a circulatory route as in the case of a conventional system.

Moreover, since the auxiliary tank 7 is connected to the discharge port 5*a* of the small pipe 5 and the cleaning solution B discharged from the discharge port 5*a* is temporarily stored in the auxiliary tank 7, it becomes possible to accurately prevent the cleaning solution B from splashing on the surrounding areas, and also accurately clean and eliminate dirt adhering to the inside of the small pipe 5.

Furthermore, since the residues remaining inside the piping 3 are washed away by the finishing liquid F stored in the finishing tank 23, the inside of the piping 3 can be finish cleaned into a clean and hygienic state.

Still more, in the case where the cleaning solution B is discharged under the pressure of the gas C sealed in the auxiliary tank 7 and made to back flow through the inside of the piping 3, there is no need, at the time of discharge of the solution, to either reverse the pump 12 or suck the cleaning solution B, thus shortening the time required for recovery and back flowing, and enabling efficient execution of the cleaning work.

Yet more, since the degree of staining of the cleaning solution B in the tanks 6, 7 is visually controlled, it becomes possible to easily grasp the state of cleaning inside the piping 3 and, when the cleaning solution B is badly stained, accurately clean and remove dirt from the inside of the piping 3 by repetition of said actions, continuation of work or replacement of cleaning solution B with new one.

The cleaning effect drops as the amount of dirt D contained in the cleaning solution B increases. By visually checking the degree of staining of the cleaning solution B either at prescribed intervals or periodically, it becomes possible to accurately grasp the time for replacement of the cleaning solution B and perform the cleaning work continuously by replacing the cleaning solution B with a new one.

Figure 8:
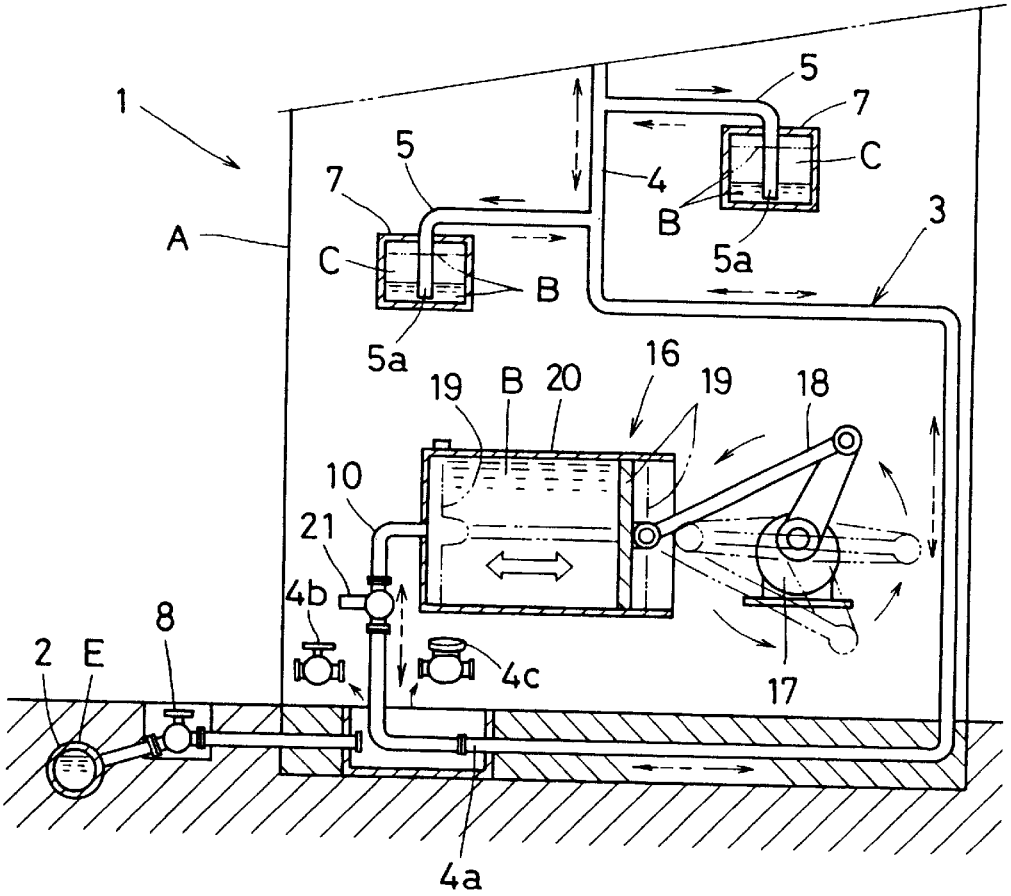
FIG. 8 is a side view indicating the actions of feeding and recovering the cleaning solution with a pump.

FIG. 8 shows a construction for cleaning the inside of the piping 3 by alternately repeating the actions of feeding the cleaning solution B to the inside of the piping 3 and recovering it by sucking, by driving an reciprocating pump 16, and the pump 16 (plunger pump, piston pump, diaphragm pump, etc.) has a cylinder 20, in which is stored the cleaning solution B, connected to the feed port 4*a* of the main pipe 4, through a solenoid valve 21, to thereby reciprocate a piston 19 in the cylinder 20 with the driving force of a motor 17, through a crank arm 18.

At the time of cleaning, the solenoid valve 21 is opened to make the piston 19 advance, and feed the cleaning solution B in the cylinder 20 to the inside of the piping 3. After that, the piston 19 is made to retreat, to suck and recover the cleaning solution B stored inside the piping 3.

Since the inside of the piping 3 is cleaned with the operation of reciprocating the piston 19 and repeating the actions of feeding the cleaning solution B to the inside of the piping 3 and sucking and recovering it to the cylinder 20, to thereby make the cleaning solution B move in one way and the other to clean the inside of the piping 3, it becomes possible to make the cleaning solution B reach all areas in the piping 3 from the main pipe 4 up to the small pipe 5 at terminal points accurately, to well clean the entire areas.

Moreover, since the pressure and impact are repeatedly applied from two directions, the dirt D adhering to the inside of the piping 3 can be accurately cleaned and removed, thus providing about the same actions and effects as those of the embodiment described earlier.

Figure 9:
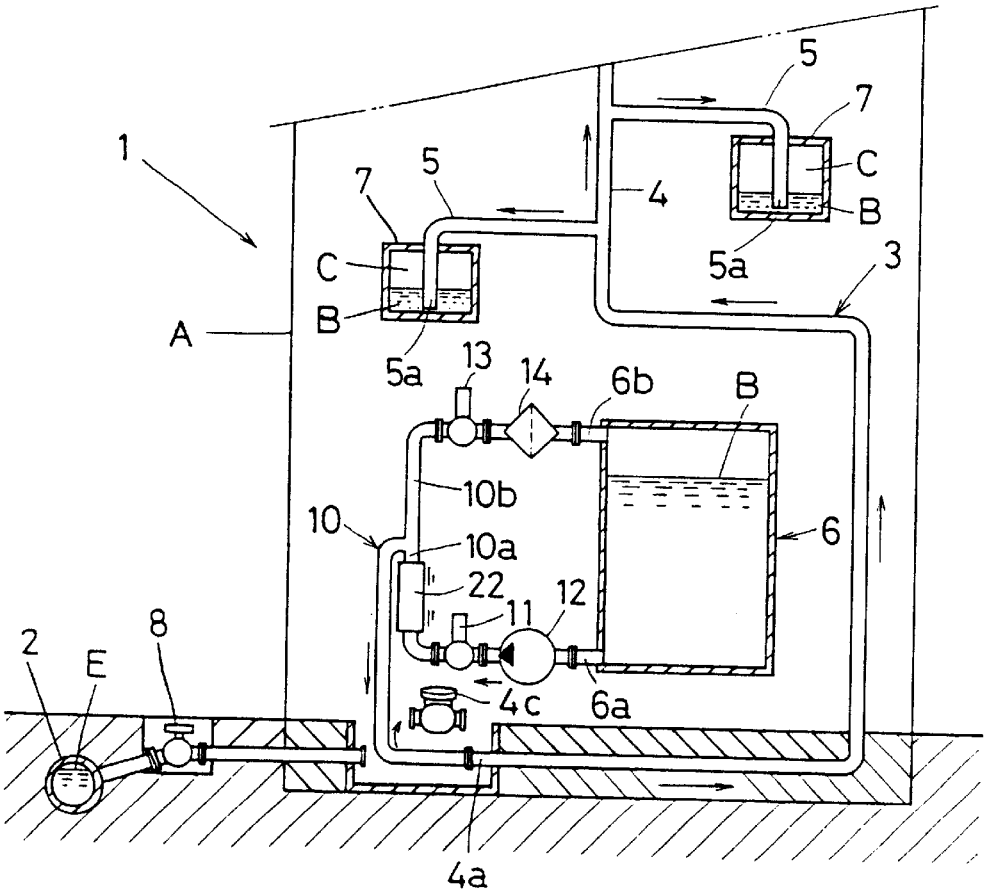
FIG. 9 is a side view indicating the action of vibrating the cleaning solution with ultrasonic waves.

FIG. 9 shows a construction for performing ultrasonic wave cleaning by furnishing the cleaning solution B with ultrasonic vibrations produced by an ultrasonic vibrator 22. In this construction, the pump 12 (or pump 16, 26) is driven to feed the cleaning solution B to the inside of the piping 3, while ultrasonic vibrations are applied to the cleaning solution B fed to the inside of the piping 3 by driving the ultrasonic vibrator 22 provided in the feed pipe 10.

In this case, by the synergism of either pulsation or reciprocation of the cleaning solution B and ultrasonic vibrations, obstinate dirt adhering to the inside of the piping 3 is accurately separated, to well clean and remove even dirties D sticking to corners and detailed parts inside the pipes, thus cleaning the inside of the piping 3 more beautifully, without being influenced by the size of pipe diameter and the situation of piping.

Furthermore, it may also be all right to provide the ultrasonic vibrator 22 in either the main pipe 4 or the small pipe 5, to furnish ultrasonic vibrations to the cleaning solution B supplied to the main pipe 4 and the small pipe 5.

The ultrasonic frequency may be variably adjusted to a value suitable for removing the dirt D.

Figure 10:
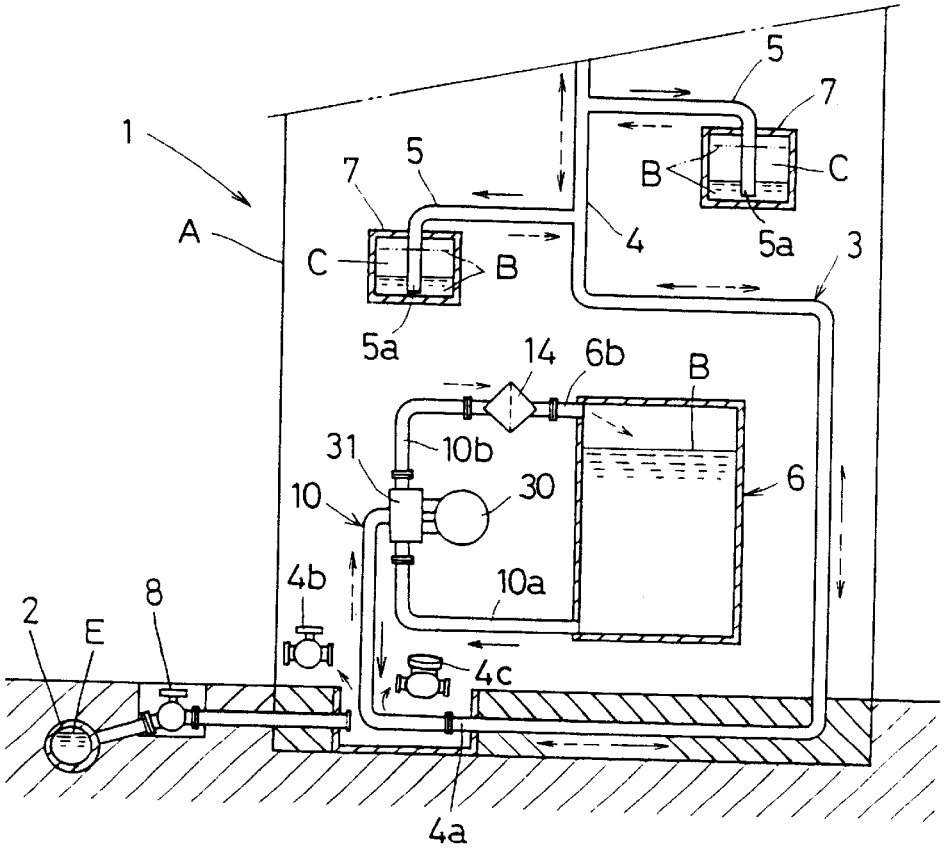
FIG. 10 is a side view indicating the action of feeding by circulating the cleaning solution.

FIG. 10 shows a construction for cleaning the inside of the piping 3 by alternately repeating the actions of feeding the cleaning solution B to the inside of the piping 3 and recovering it by means of switching operation of a selecting valve 31, without stopping or making normal or reverse turns of a circulation pump 30. After the feed pipe 10 is connected to the feed port 4*a* through the pump 30 and the selecting valve 31, the circulation pump 30 is driven continuously, to alternately repeat the actions of feeding the cleaning solution B to the auxiliary tank 7 through the inside of the piping 3 and recovering that cleaning solution B to the main tank 6 by flowing it back through the inside of the piping 3, providing about the same actions and effects as those of the embodiment described earlier, making stop and reversing of the pump 12 unnecessary, and enabling continuous operation, thus making it possible to perform operations of feeding and recovering cleaning solution continuously and quickly, and improve efficiency of the cleaning work.

In the correspondence between the construction of the present invention and the embodiment described above, while the liquid feed means and the liquid pulsating feed means of the present invention correspond to the feed pipe 10 and the solenoid valves 11, 13, pumps 12, 26, and, in the same way hereafter, the liquid storing tank corresponds to the main tank 6, the sealed tank corresponds to the auxiliary tank 7, the feed route corresponds to the branch pipe 10*a*, the recovery route corresponds to the branch pipe 10*b*, the reciprocating means corresponds to the pump 16, the finishing liquid feed means corresponds to the finishing tank 23, the switching means corresponds to the selecting valve 31, and the ultrasonic wave furnishing means corresponds to the ultrasonic vibrator 22, the present invention is not restricted to the construction of the embodiment described above.

The above-described valves 11, 13, 21, 27, 31, which are driven electromagnetically, may also be driven by actuator.

What is claimed is:

1. A pipe cleaning device comprising:

a storage tank for storing a prescribed volume of cleaning solution therein, said storage tank being connected to one end of a pipe an inside of which is to be cleaned;

at least one sealed tank connected to another end of said pipe for storing said cleaning solution and pollutant removed from said inside of said pipe and discharged from said other end of said pipe during a cleaning stage;

means for supplying a gas to said at least one sealed tank to cause discharge of said cleaning solution and pollutant stored therein in a recovery stage;

feed means for selectively feeding said cleaning solution from said storage tank, through said pipe, to said at least one sealed tank in said cleaning stage, and for selectively feeding said cleaning solution and pollutant from said at least one sealed tank,through said pipe, through a filter means, to said storage tank in said recovery stage;

said filter means disposed between said other end of said pipe and said storage tank for filtering out said pollutant from said cleaning solution when fed from said at least one sealed tank to said storage tank;

wherein said feed means comprises switching means for switching flow of said cleaning solution and flow of said cleaning solution and pollutant so that said cleaning solution is fed from said storage tank through said inside of said pipe and to said at least one sealed tank is said cleaning stage, and so that said cleaning solution and pollutant is fed from said at least one sealed tank,through said pipe, through said filter means, to said storage tank in said recovery stage; and wherein said feed means further comprises means for pressurized pulsing of flow of cleaning solution during said cleaning stage and for releasing said pressurized pulsing during said recovery stage, so that said gas in said at least one sealed tank causes said cleaning solution and pollutant to flow from said at least one sealed tank through said pipe, through said filter means, to said storage tank, and so that said prescribed volume of cleaning solution is retained.

2. The device of claim 1, wherein said pipe has at least two other ends; and further comprising at least two sealed tanks connected thereto.

3. The device of claim 1, wherein said means for pressurized pulsing comprises a mechanical reciprocating piston which acts to provide a pulsing pressurized feeding of said cleaning solution.

4. The device of claim 1, wherein said feed means comprises an ultrasonic wave means for providing ultrasonic waves to create pulsing action of said cleaning solution.

5. The device of claim 1, wherein at least one of said storage tank and said at least one sealed tank comprises a visual opening for visual inspection and control of said cleaning solution.

6. The device of claim 1, wherein further comprising:

finishing means for storing a finishing liquid; and wherein said feed means comprises means for connecting said finishing means to said one end of said pipe, and means for feeding said finishing liquid to said pipe.

* * * * *